US010107577B2

(12) United States Patent
Kuhnle et al.

(10) Patent No.: US 10,107,577 B2
(45) Date of Patent: Oct. 23, 2018

(54) LOCKABLE SELF-LOADING FIREARM APPARATUS

(71) Applicant: Heckler & Koch GmbH, Oberndorf/Neckar (DE)

(72) Inventors: Alexandra Kuhnle, Sulz (DE); Tobias Maier, Hirrlingen (DE); Christian Deubig, Ebhausen (DE); Wilhelm Fischbach, Deißlingen (DE)

(73) Assignee: Heckler & Koch GmbH, Oberndorf (DE)

( * ) Notice: Subject to any disclaimer, the term of this patent is extended or adjusted under 35 U.S.C. 154(b) by 0 days.

(21) Appl. No.: 15/914,896

(22) Filed: Mar. 7, 2018

(65) Prior Publication Data

US 2018/0259275 A1 Sep. 13, 2018

(30) Foreign Application Priority Data

Mar. 7, 2017 (DE) ..... 10 2017 002 190

(51) Int. Cl.
*F41A 3/26* (2006.01)
*F41A 5/18* (2006.01)

(52) U.S. Cl.
CPC . *F41A 3/26* (2013.01); *F41A 5/18* (2013.01)

(58) Field of Classification Search
CPC ..... F41A 3/26; F41A 5/18
See application file for complete search history.

(56) References Cited

U.S. PATENT DOCUMENTS 1,138,376 A * 5/1915 Hammond ..... F41A 3/26 42/25
1,586,434 A * 5/1926 Adams ..... F41A 5/18 89/185

(Continued)

FOREIGN PATENT DOCUMENTS

DE 459454 5/1928
DE 478630 6/1929

(Continued)

*Primary Examiner* — Michelle Clement
(74) *Attorney, Agent, or Firm* — Hanley, Flight & Zimmerman, LLC.

(57) ABSTRACT

Example apparatus are disclosed for a lockable self-loading firearm, comprising a bolt head comprising a feed regulator pin extending traverse to a longitudinal direction with respect to the firearm, a breechblock carrier in a receiver movable in a longitudinal direction with respect to the firearm, the breechblock carrier comprising a control guide extending diagonally in the longitudinal direction with respect to the firearm through which the feed regulator pin is disposed, the control guide comprising a releasing control edge, comprising a first straight edge section positioned at a shallow angle with respect to the longitudinal direction, a second straight edge section positioned at a significantly greater angle than the first straight edge section with respect to the longitudinal direction, a third curved edge section with tangents positioned at increasingly greater angles than the second straight edge section with respect to the longitudinal direction, a locking control edge opposite the releasing control edge, the locking control edge comprising a fourth straight edge section positioned parallel with respect to the second straight edge section, a fifth straight edge section positioned parallel with respect to the first straight edge section, and at a releasing end of the releasing control edge, a sixth arc-shaped edge section connecting a first end of the third curved edge section and a second end of the first (Continued)

straight edge section to receive the feed regulator pin in a releasing position, wherein the sixth arc-shaped edge section has a greater diameter than the feed regulator pin with respect to the longitudinal direction.

15 Claims, 9 Drawing Sheets

(56) References Cited

U.S. PATENT DOCUMENTS 2,424,264 A * 7/1947 Yorks ..... F41A 3/26 42/16
2,941,449 A * 6/1960 Reed ..... F41A 3/26 42/16
3,318,192 A 5/1967 Miller et al.
3,329,064 A * 7/1967 Segrest ..... F41A 5/18 89/128
3,507,187 A * 4/1970 Maillard ..... F41A 3/26 89/185
3,645,165 A * 2/1972 Wohlford ..... F41A 3/26 89/11
3,648,562 A * 3/1972 Loeble ..... F41A 19/13 89/148
3,667,147 A * 6/1972 Goldin ..... F41A 9/45 42/15
3,675,534 A * 7/1972 Beretta ..... F41A 3/26 89/185
3,713,363 A * 1/1973 Hurlemann ..... F41A 5/18 89/185
3,866,513 A * 2/1975 Hornfeck ..... F41A 3/10 89/24
3,955,470 A 5/1976 Kruzell
3,969,983 A * 7/1976 Zellweger ..... F41A 3/26 89/185
3,996,684 A * 12/1976 Bauman ..... F41A 3/26 42/16
4,022,105 A * 5/1977 White ..... F41A 3/26 89/149
4,028,993 A * 6/1977 Reynolds ..... F41A 3/78 89/130
4,061,074 A * 12/1977 Johnson ..... F41A 5/22 89/33.25
4,191,089 A * 3/1980 Zedrosser ..... F41A 3/26 89/181
4,213,261 A * 7/1980 Claypool ..... F41A 3/40 42/16
4,244,270 A * 1/1981 Tassie ..... F41A 7/08 74/107
4,348,937 A * 9/1982 Kuffer ..... F41A 19/37 89/24
4,389,919 A * 6/1983 Kast ..... F41A 19/02 89/185
4,398,448 A * 8/1983 LaFever ..... F41A 3/26 89/185
4,506,589 A * 3/1985 Junker ..... F41A 3/40 89/190
4,604,942 A * 8/1986 Benelli ..... F41A 3/26 89/166
4,655,118 A * 4/1987 Bruderer ..... F41A 3/30 89/185
4,920,855 A * 5/1990 Waters ..... F41A 3/26 89/172
4,930,399 A * 6/1990 Trevor, Jr. ..... F41A 3/46 89/185
4,982,649 A * 1/1991 Koine ..... F41A 3/26 89/185
5,117,735 A * 6/1992 Flashkes ..... F41A 3/26 89/185
5,886,281 A * 3/1999 Kirstein ..... F41A 3/26 89/185
5,920,028 A * 7/1999 Guhring ..... F41A 3/26 42/16
6,742,434 B1 * 6/2004 Dillon ..... F41A 3/26 42/16
7,721,639 B2 * 5/2010 Wossner ..... F41A 21/484 42/14
8,677,883 B2 * 3/2014 Wossner ..... F41A 3/30 89/185
8,713,833 B2 * 5/2014 Lewis ..... F41A 3/26 42/16
8,800,422 B2 * 8/2014 Norton ..... F41A 3/26 42/16
9,377,256 B2 * 6/2016 Withey ..... F41A 3/22
2015/0338181 A1 * 11/2015 McAlister ..... F41A 19/10 42/6
2016/0040956 A1 * 2/2016 Giannelli ..... H05K 999/99 42/17
2016/0076836 A1 * 3/2016 Young ..... F41A 5/28 89/194

FOREIGN PATENT DOCUMENTS

DE 2812732 6/1979
DE 19616397 11/1997

* cited by examiner

LOCKABLE SELF-LOADING FIREARM APPARATUS

FIELD OF THE DISCLOSURE

This disclosure relates generally to a lockable self-loading firearm according to teachings disclosed herein.

BACKGROUND

A firearm of this type is known from DE 196 16 397 C2 (Gühring et al.) and has proven extremely successful, in particular under difficult conditions, e.g. in the sand and mud test according to NATO AC225.

Similar firearms are known, for example, from DE-PS 478 630, together with the related patent DE-PS 459 454 (both from Kiraly), DE 28 12 732 A (Zedrosser), U.S. Pat. No. 2,941,449 (Reed), U.S. Pat. No. 4,604,942 (Benelli), U.S. Pat. No. 3,318,192 (Miller), U.S. Pat. No. 3,955,470 (Kruzell); likewise as assault rifles HK416, Steyr Aug, FN C.A.L. and US automatic rifle M16.

In military applications, large-scale police actions, or hunting expeditions, it is frequently necessary to carry firearms such as lockable self-loading firearms such that they are fire ready, or at least only secured and in the open, without any opportunity for cleaning the firearm. As a result, it is impossible to keep sand, dust and mud from accumulating in the firearm mechanism.

Moreover, the firearm is often heavily oiled for misconceived cautionary reasons. When the reloaded cartridge is no longer fully oil-tight, e.g. due to a harmful effect thereto during the reloading procedure, or for any other reason, oil can penetrate the cartridge, and have a negative effect on the propellant. This results in a so-called "dud shot."

If a shot then needs to be taken in a dangerous situation, the firearm may jam, because either the returning breechblock is braked too strongly by accumulated dirt, or the effect of the combustion gas on the reload mechanism is insufficient because of an ammunition malfunction.

Further shots remain unaffected, because the breechblock movement sweeps the dirt aside, such that no more disruptions are to be expected with the subsequent cartridge.

The problems outlined above have all been solved ideally in the aforementioned DE 196 16 397 C2 (Gühring et al.)

DETAILED DESCRIPTION

Figure 1:
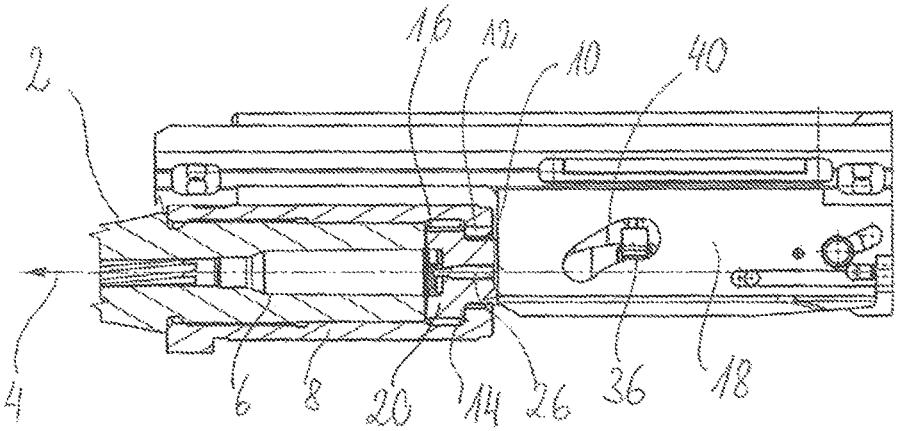
FIG. 1 is a lateral view of a rear end of a firearm barrel with a breechblock carrier in a locked setting.
Figure 2:
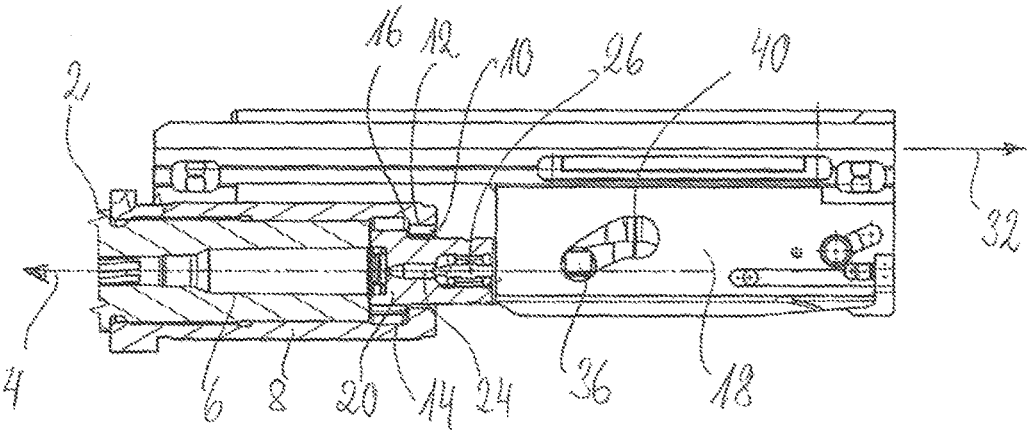
FIG. 2 is a lateral view of the firearm barrel of FIG. 1 with the breechblock carrier in a released setting.

The teachings of this disclosure create an alternative breechblock control, which is better adapted to the relative forces in the firearm during the self-loading procedure and can be produced easily. This is achieved by a lockable self-loading firearm in accordance with the teachings of this disclosure.

The division of the releasing control edge into three different edge sections transitioning into one another with respectively increasing angles in relation to the longitudinal direction serves to optimize the releasing function of the bolt head guided by the control guide via the feed regulator pin. When the breech is opened, the control guide of the backward moving breechblock carrier meets/contacts/hits with its first releasing edge section at a very shallow angle to/on the longitudinally stationary feed regulator pin of the bolt head. This first releasing edge section serves as a lifter slant/angle for releasing and initiating movement of the bolt head subjected to contact pressure. Because of the shallow angle, the returning breechblock carrier loses very little speed, as is known per se from DE-PS 478 630 and DE-PS 459 454 (Kiraly). The subsequent second releasing edge section accelerates the rotational movement of the bolt head toward its released position via the feed regulator pin. This is likewise known per se from the two aforementioned German patent applications by Kiraly. As a result of its curvature, the subsequent third releasing edge section further accelerates the rotational movement of the bolt head in a continuous manner, until it reaches its final, released position.

The feed regulator pin remains in the sixth edge section of the control guide, adjoining the releasing edge section, and retains the bolt head therewith in its released position. It then participates in the return movement of the breechblock carrier. It releases the discharged/deobturated casing in the chamber and thereby removes it. The following has been demonstrated in ballistic tests: after the cartridge has been fired and the casing has been released, and its removal from the chamber has been initiated, there is still a residual gas pressure in the chamber and the barrel, that has no detrimental effect on the safety of the firearm. This residual gas pressure accelerates the discharged/deobturated casing in the chamber, as well as the returning bolt head together with the feed regulator pin, toward the rear. The bolt head would actually overtake the returning breechblock carrier as a result of this rearward acceleration if not for the feed regulator pin bearing on the control guide. This phenomenon is exploited in that the longitudinal diameter of the sixth edge section is slightly greater than the diameter of the feed regulator pin. As a result, the feed regulator pin, carried backward by control guide, initially has a smaller spacing to the right-hand lower part, i.e. the lower part facing toward the rear, of the sixth curved section, and imposes an impulse, resulting from the aforementioned supplementary acceleration, which in turn further accelerates the return movement of the overall breechblock carrier. At the same time, this impulse—corresponding to the increase in the longitudinal diameter—is somewhat delayed, which has proven to be very beneficial in ballistic tests. The breechblock carrier and the bolt head are thus accelerated on the whole toward the closing spring, where they are then brought to a standstill before being accelerated back toward the front.

The bolt head comes to a standstill just in front of the chamber—but not the breechblock carrier. Its front edge, which is rounded, for example, at the transition from the sixth to the fourth edge section lifts the feed regulator pin abruptly. The locking rotation of the bolt head begins, and becomes slower at the fourth edge section, and the bolt head is then gently guided from the fifth locking edge section to the end.

Preferred embodiments are disclosed herein.

The bolt head is moveable in the longitudinal direction to lock and release the firearm, and wherein a rear of the bolt head is pivotally mounted in the breechblock carrier to allow rotation about the longitudinal direction. The bolt head remains longitudinally stationary during an opening movement of the breechblock carrier, and wherein the bolt head rotates with the opening and a closing movement of the breechblock carrier as a result of the releasing control edge releasing the feed regulator pin. The bolt head is stationary during a start phase of the closing movement, and wherein the bolt head rotates backward during an end phase of the closing movement as a result of the locking control edge locking the feed regulator pin.

A radius of curvature of a portion of the sixth edge section connecting to at least one of the third edge section or the fourth edge section corresponds to a radius of the feed regulator pin. This measure ensures a good retention of the feed regulator pin in its fully released position during the return and subsequent advancing movement of the breechblock carrier; it likewise ensures a good transference of the rearward impulse exerted by the discharged/deobturated casing, as a result of the residual gas pressure in the barrel, on the bolt head, together with the feed regulator pin, and ultimately—via the rear end of the sixth edge section—on the breechblock carrier.

Results of ballistics tests have shown that the difference between a longitudinal diameter of the sixth edge section and a diameter of the feed regulator pin is preferably within a range of 0.2 mm to 1 mm, particularly preferably within a range of 0.3 mm and 0.8 mm, and in particular in the range of 0.4 mm to 0.6 mm. For a concrete selection of this diameter difference however, the firearm geometry as well as the ammunition that is to be used, e.g. Kal. 5.56×45 NATO, and in particular the propellant, must be taken into account.

A seventh edge section connects a first end of the first edge section with a second end of the fifth edge section in a substantially U-shaped manner at the locking control edge, and wherein the first end and the second end of the seventh edge section are parallel with respect to the longitudinal direction and transition into the first edge section and the fifth edge section respectively. A first length of the first end of the seventh edge section is longer than a second length of the second end of the seventh edge section, and wherein the first length measures 6 mm and the second length measures 2 mm. This measure ensures that the feed regulator pin is securely seated when the bolt head is in the locked position. At the same time, it ensures that the releasing rotation of the bolt head is delayed, depending on the length of the U-legs, i.e. when the gas pressure in the barrel has diminished sufficiently. In addition, this allows the breechblock carrier to move before its control guide starts to pivot the feed regulator pin.

A good guidance of the feed regulator pin in the control guide is obtained in that a first spacing between the first edge section and the fifth edge section, a second spacing between the second edge section and the fourth edge section, and a third spacing between a first end and a second end of a seventh edge section substantially correspond to a diameter of the feed regulator pin, preferably being a few hundredths of a millimeter greater than this diameter.

Results of ballistics tests have shown that the control guide allows for longitudinal displacement of the breechblock carrier with respect to the feed regular pin within a range of 9 mm to 17 mm, preferably within a range of 11 mm to 15 mm, and in particular within a range of 12 mm to 14 mm.

The same applies for the measure of a first angle corresponding to the first edge section within a range of 16° to 32° with respect to the longitudinal direction, preferably within a range of 20° to 28°, and particularly preferably within a range of 22° to 26°; a second angle corresponding to the second edge section within a range of 30° to 45° with respect to the longitudinal direction, preferably within a range of 34° to 41°, and particularly preferably within a range of 35° to 40°, and a third angle corresponding to at least one of the tangents of the third edge section is within a range of 55° to 85° with respect to the longitudinal direction, preferably within a range of 60° to 80°.

At least one of the sixth arc-shaped edge section or an exterior surface of the feed regulator pin that is adjacent or opposite the sixth arc-shaped edge section comprises a recess to receive dirt at a front end with respect to the longitudinal direction. As a result, the start of the releasing rotation of the bolt head is further delayed, i.e. it is released at an even lower pressure.

The problem of dirt referred to in the introductory portion of the description, and considered in particular in DE 196 16 397 C2 (Gühring et al.) shall be resolved in that at least one of the sixth arc-shaped edge section or an exterior surface of the feed regulator pin that is adjacent or opposite the sixth arc-shaped edge section comprises a recess to receive dirt at a front end with respect to the longitudinal direction. The problem of dirt usually only arises with the first shot, because further shots or movements of the feed regulator bolt in the control guide normally ensure that the dirt falls off of the control edges.

A horizontal guide rail is disposed in the receiver and retains the feed regulator pin in a released position when returning and advancing with the breechblock carrier, and wherein the horizontal guide rail dismisses the feed regulator pin when locking lugs of the bolt head advance to a position between one of corresponding counter-locking lugs on a rear end of a rear barrel attachment or a locking bushing.

The control guide is disposed opposite a cartridge ejection port with respect to a lateral direction, and wherein the releasing control edge is positioned above the locking control edge. This measure prevents the accumulation of dirt on the releasing edge. Specifically, the dirt falls off more easily due to gravity.

Designing the firearm as a gas-operated reloading firearm has the advantage that further control measures via a regulated gas discharge on the barrel can be taken, in particular after any replacement of the barrel and associated changes in caliber and propellant.

Exemplary embodiments of the invention shall be explained below on the basis of the attached schematic drawings.

The same reference symbols are used consistently throughout the figures for identical elements. Explanations of one figure relate analogously to the respective other figures.

FIGS. 1 to 4*b* each show the breechblock system or parts thereof in an automatic firearm designed as a gas-operated reloading firearm. The barrel 2, with its bore axis corresponding to the longitudinal direction 4, has a chamber 6 at its rear end, and is non-rotatably secured in a locking sleeve 8, which in turn is rigidly mounted in the (not shown) receiver. The rear end of the locking sleeve 8 has a round opening 10 from which radial grooves 12 extend, disposed evenly about its circumference, each of which has a basically rectangular cross section. A round chamber 16 is formed between the front edge 14 of this opening and the rear end of the barrel 2, the inner diameter of which basically corresponds to the diameter formed by the bases of the grooves in the round opening 10.

The breechblock has a breechblock carrier 18 and a bolt head 20 supported therein, which can be displaced longitudinally and rotated. The bolt head 20 has a cross section with projections or locking lugs 22 at its front end that are complementary to the round opening 10 in the locking sleeve 8, the geometries of which correspond to the radial grooves 12, and has a length that corresponds to the length of the chamber 16.

The bolt head 20 can thus be inserted through the opening 10, at a rotational angle oriented to the round opening 10, into the round chamber 16. This rotational angle of the bolt head corresponds to its fully released position. The bolt head 20 is rotated from this position into its locked rotational position as the breechblock carrier 18 advances, and is again fully released after a cartridge has been fired. Its released rotational position must be maintained by the bolt head 20 during its subsequent return with the breechblock carrier 18 and the subsequent advance, until it has again advanced through the round opening 10.

If the bolt head 20 then rotates again in this position, its locking lugs 22 engage behind the webs, also referred to as counter-lugs, between the radial grooves 12 of the locking sleeve 8, while the bolt head 20 simultaneously bears on the rear end of the barrel 2, or nearly bears thereon. The bolt head 20 can no longer be moved in a straight line in the longitudinal direction 4 of the barrel 2, i.e. it is "locked." If it is rotated back to its previous position, i.e. "released," it can then be pulled back out of the round chamber 16.

Figure 3:
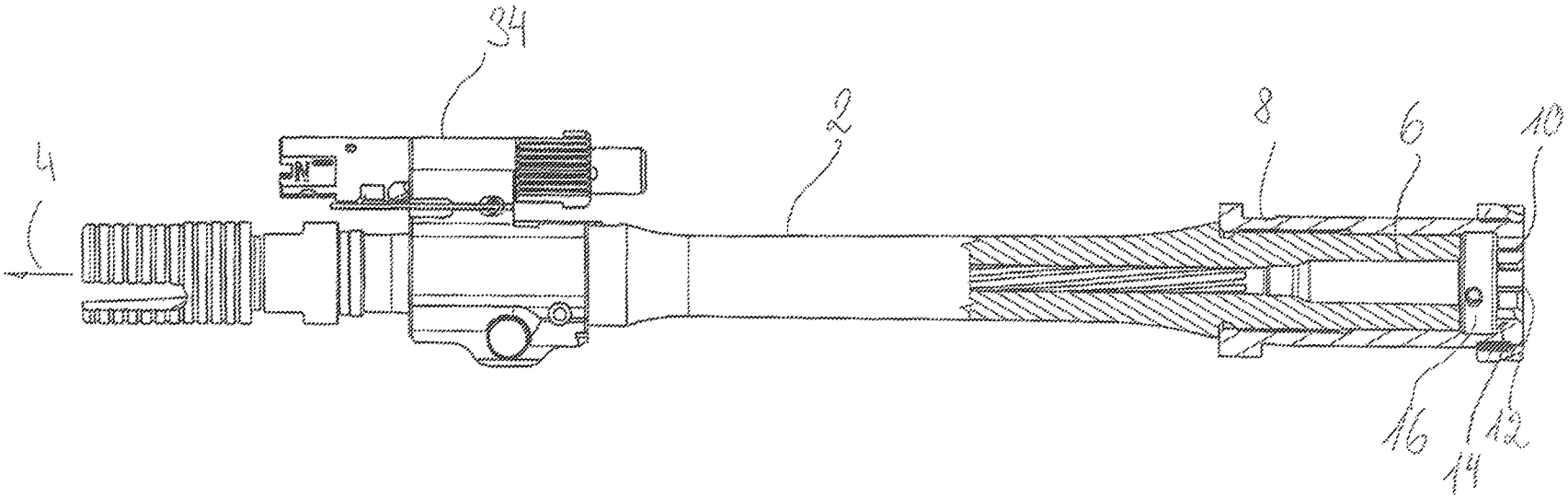
FIG. 3 is a lateral view of a firearm barrel with locking lugs and a gas discharge.

The bolt head 20 is guided at its rear end into the breechblock carrier 18. The breechblock carrier 18 is moved backwards against a (not shown) closing spring, in the direction of the arrow 32, by means of a (not shown) gas-piston mechanism (FIG. 3 shows only a gas pressure relief mechanism 34 of the barrel 2) when a shot is fired, and then forced by this spring back into the advance.

Figure 4A:
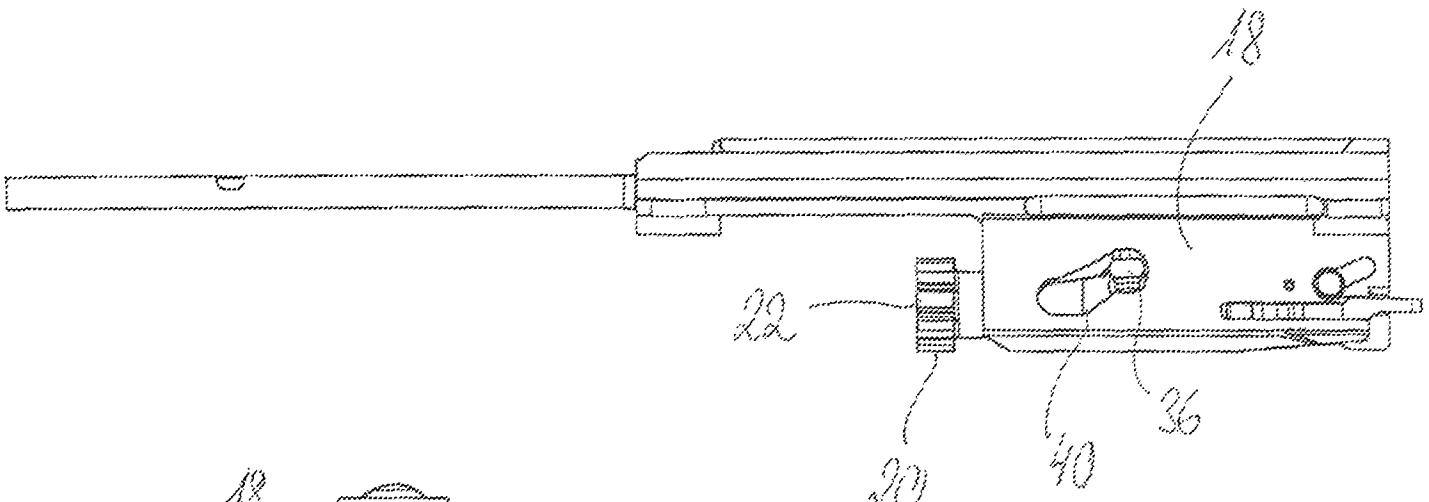
FIG. 4*a* is lateral view of a breechblock carrier with a bolt head.
Figure 4B:
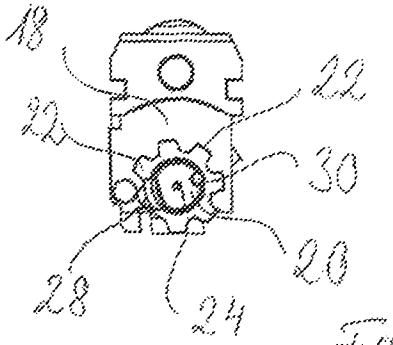
FIG. 4*b* is a top view of the breechblock carrier of FIG. 4*a*.

The figures also show a bore 24 for the firing pin 26 that passes through the bolt head 20; FIG. 4*b* also shows a cartridge remover 28 and a cartridge ejector 30. A feed regulator pin 36 attached to the rear part of the bolt head 20 passes through a control guide 40 configured as a slot in a wall of the breechblock carrier 18.

Figure 5:
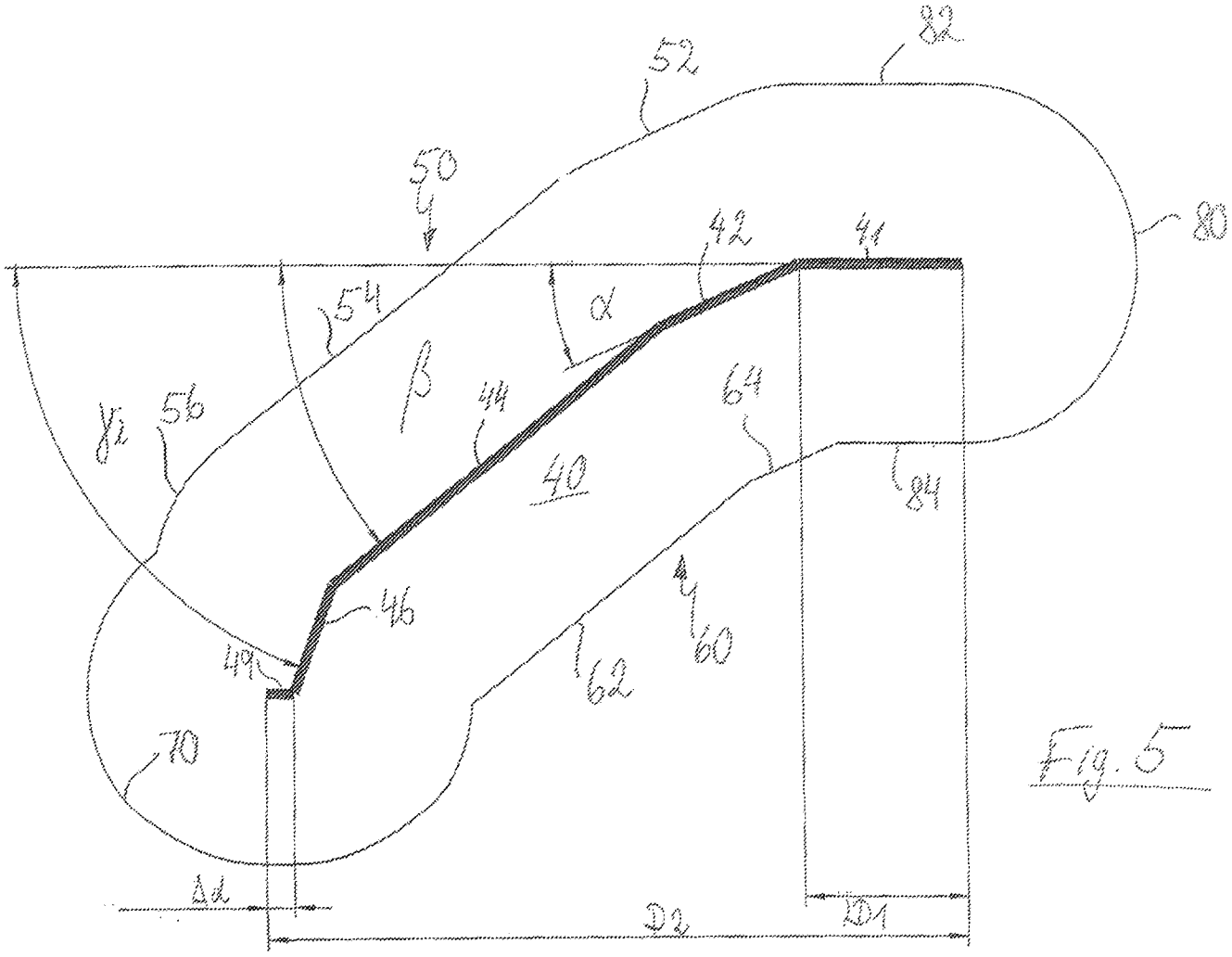
FIG. 5 is an enlarged lateral view of a contour of the control guide of the breechblock carrier of FIGS. 1-2.

FIG. 5 shows, schematically, the contours of the control guide 40, in an enlarged scale.

When the bolt head 20 is locked (FIG. 1) or is in a locked position (FIGS. 4*a* and 6), the breechblock carrier 18 is in its foremost position, and is located at the rear end of the barrel 2. The feed regulator pin 36 lies accordingly shortly before the rear end of the U-shaped seventh edge section 80. When a shot is fired, the breechblock carrier 18 is moved in the direction of the arrow 32 in FIG. 2, and slides with its legs and edge sections 82, 52, 54 and 56 shown in FIG. 5 over the feed regulator pin 36. Because the bolt head 20 is locked, it remains longitudinally stationary, as does the feed regulator pin 36 rigidly connected thereto. The bolt head 20 can rotate thereby in the breechblock carrier 18, such that the releasing control edge 50 first, using its first edge section 52, subsequently its second edge section 54, and lastly its third edge section 56, pushes it increasingly downward, thereby rotating it in the counterclockwise direction—seen from the rear—at an accelerating speed, until it reaches the released position. After leaving the third releasing edge section 56, the feed regulator pin 36 remains in the sixth edge section 70. When the bolt head 20 is in this fully released position, its locking lugs 22 are flush with the radial grooves 12 of the locking sleeve 8. As it continues to return, the breechblock carrier 18 then carries the bolt head 20 along with it, i.e. it pulls the bolt head 20 out of the chamber 16. The residual gas pressure remaining in the barrel 2 then accelerates the casing toward the rear, such that an impulse is transferred via the bolt head 20 and the feed regulator pin 36 onto the rear edge of the sixth edge section 70 of the control guide 40, and thus to the breechblock carrier 18. The breechblock carrier 18 is also accelerated as a result, thus traveling further, due to this exploitation of energy.

The returning breechblock carrier 18, together with the bolt head 20, then strikes (in the known manner) a (not shown) closing spring, until brought to rest by the spring force, after which it is advanced by the closing spring.

The feed regulator pin 36 is in the rear section of the sixth edge section 70 during this forward movement. This advance continues until the bolt head 20 is in front of the rear end of the barrel 2. As soon as it and the feed regulator pin 36 are longitudinally stationary, the feed regulator pin 36 is rotated away from the locking control edge 60, specifically its fourth and fifth edge sections 62 and 64, into the locked position—thus in the clockwise direction, seen from behind. It is then again in the locked position shown in FIGS. 1 and 6.

The ejection of the empty cartridge during the return of the bolt head 20 and the loading of a new cartridge during its advance take place in a manner known per se.

Figure 12:
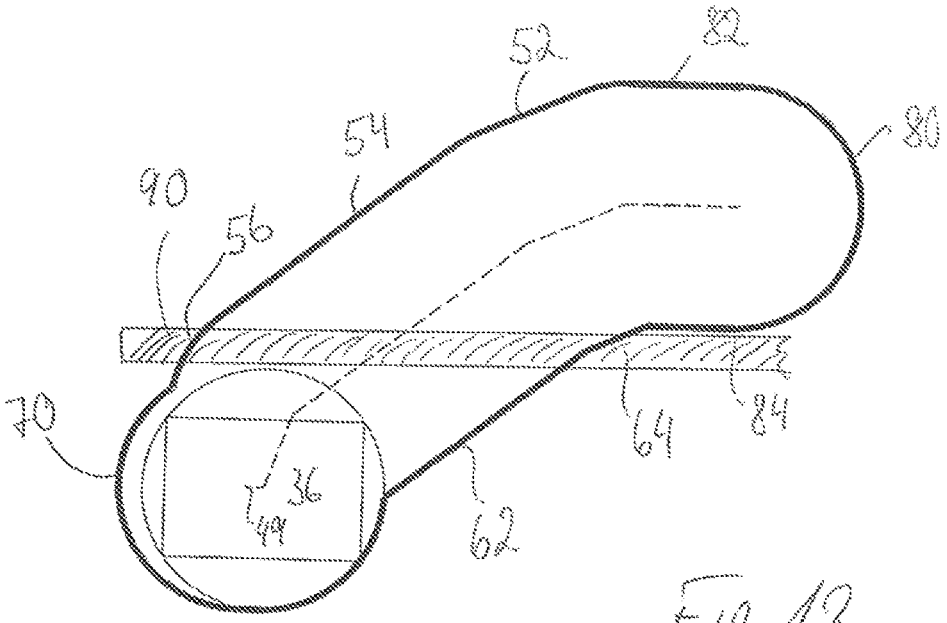

Moreover, the fully released rotational position of the bolt head 20 during its collective back and forth movement with the breechblock carrier 18 can be additionally secured by an engagement of the feed regulator pin 36 in a guide rail 90 attached on the inside of the receiver (see FIG. 12).

The seventh edge section 80 (e.g., rear edge section) of the control guide 40 is U-shaped, and receives the feed regulator pin 36 in its locked pivotal position. It transitions with its two legs running in the longitudinal direction 4, into the first releasing edge section 52 and the first locking edge section 64, respectively. The lengths of these two U-legs determines the distance D1 that the breechblock carrier initially returns after a shot is fired, thus accumulating momentum before its releasing control edge 50 engages with the feed regulator pin 36.

It can furthermore be derived from FIG. 5 that the breechblock carrier 18, and thus its control guide 40, travels a distance D2 in relation to the bolt head 20, for a complete rotation thereof to its released or locked position, the length of which—depending on the geometry of the firearm and the ammunition that is used, e.g. Kal. 5.56×45 NATO, in particular the propellant—preferably lies in a range of 9 mm to 17 mm, more preferably 11 mm to 15 mm, particularly preferably 12 mm to 14 mm, e.g. 13 mm. The midpoint of the free end of the feed regulator pin 36 lying in the control guide 40 basically travels the distance indicated by the reference numerals 41, 42, 46 and 49 thereby. The exploitation of the barrel residual gas pressure acting on the discharged/disobturated cartridge referred to above serves to cover the distance Δd 49. The length of Δd corresponds to the difference between the longitudinal diameter of the sixth edge section 70 and the diameter of the feed regulator pin 36. It is preferably in a range of 0.2 mm to 1 mm, in particular 0.3 mm to 0.8 mm, particularly preferably in a range of 0.4 mm to 0.6 mm, e.g. 0.5 mm. Although the curvature radii of the front and rear regions of the sixth edge section 70 are adapted to the radius of the feed regulator pin 36, the longitudinal diameter of this edge section is extended by the additional distance Δd 49, and is thus greater than the diameter of the feed regulator pin 36.

According to FIG. 5, the releasing control edge 50 is composed of the first straight edge section 52, at a relatively shallow angle α to the longitudinal direction 4, the subsequent straight second edge section 54, at a significantly steeper angle β to the longitudinal direction 4, and a subsequent curved third edge section 56, the collective tangents $\gamma_i$ of which are at a greater angle to the longitudinal direction 4 than the second edge section 54 with its angle β. These angles preferably lie—depending on the internal firearm geometry and the caliber used, in particular the propellant—in the following ranges: angle α in a range of 16° to 32°, preferably 20° to 28°, particularly preferably 22° to 26°, e.g. 24°; angle β in a range of 30° to 45°, preferably 34° to 41°, particularly preferably 35° to 40°, e.g. 38°. The third angles $\gamma_i$ of the tangents of the curved sixth releasing edge section 70 range between 55° and 85°, preferably 60° to 80°.

The first edge section 52 with the angle α ensures a smooth entry of the control guide 40 into its releasing function, and is significantly shorter than the second edge section 54. The greater angle β thereof accelerates the releasing rotation of the bolt head 20, at the end of which the third edge section 56, in the form of a curved edge section, further accelerates the rotation of the feed regulator pin 36. In its fully released position, the feed regulator pin 36 is located in the sixth edge section 70, and initially bears with its forward, i.e. oriented in the longitudinal direction 4, peripheral section on the likewise forward section of the sixth edge section 70. The two adjacent regions of the feed regulator pin 36 and the edge section have radii corresponding to one another.

When the cartridge is subsequently removed from the chamber 6, this cartridge is again accelerated backwards due to the residual gas pressure in the barrel, and transfers its impulse via the bolt head 20 and the feed regulator pin 36 attached thereto to the rear section of the sixth edge section 70. Here as well, the radii of the feed regulator pin 36 and the curvature radius of the rear section of the sixth edge section 70 are adapted to one another. The impulse transfer causes a further acceleration of the breechblock carrier 18, and thus exploits the residual pressure force in the barrel.

After its return and subsequent advance, the bolt head 20 comes to a standstill in the round chamber 16 in front of the chamber 6. The locking control edge 60 of the breechblock carrier 18 continues to advance in the longitudinal direction 4 then acts on the feed regulator pin 36, and locks the bolt head 20 with its edge sections 62 and 64. These two edge sections are parallel to the aforementioned releasing edge sections 52 and 54. If the bolt head 20 is locked, the breechblock carrier advances slightly, but not so far that the feed regulator pin 36 strikes the rear end of the seventh edge section 80. It is braked by suitable means prior thereto. After firing a first shot, the cycle described above begins anew.

With contemporary firearms, a cadence of at least 600 shots per minute can be assumed, i.e. 10 shots per second, each involving 10 returns and advances of the control guide 40 per second, and a corresponding number of guidance procedures on the part of the breechblock system.

FIGS. 6 to 14 show the control guide 40 of the breechblock carrier 18 and the feed regulator pin 36 in their different functional positions during one cycle of the breechblock control.

Figure 6:
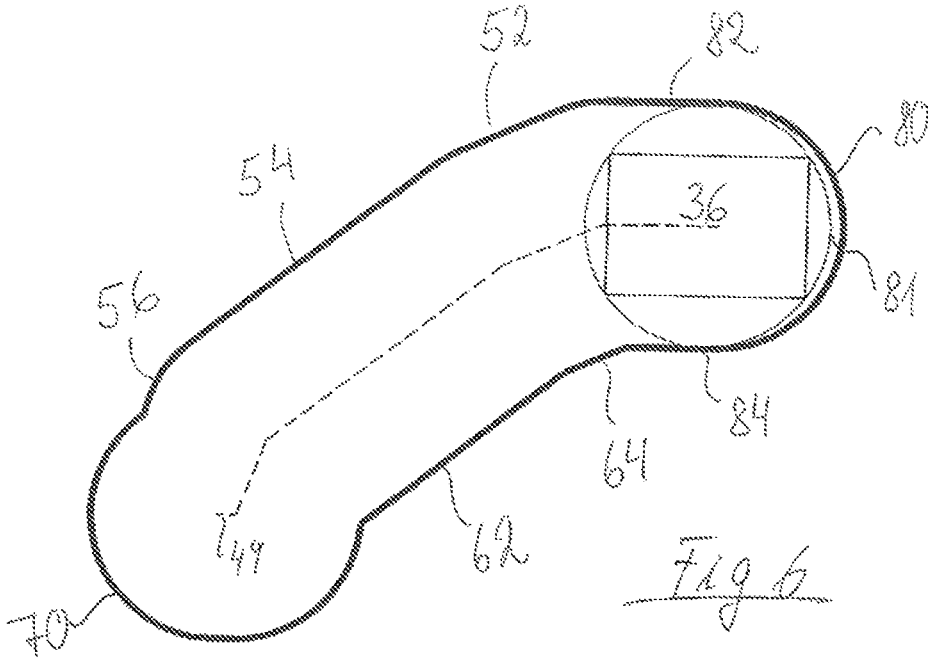
FIGS. 6-14 are lateral views of a feed regulator pin in various functional positions within the control guide.

FIG. 6 shows the feed regulator pin 36 when the bolt head 20 is in its locked position—as known, in the upper, rear horizontal niche of the control guide 40 of the breechblock carrier 18. The control guide 40 is located—as already known from DE 196 16 397 C2 (Gühring et al.) specified in the introductory portion of this application—at the left-hand, vertical side of the breechblock carrier 18, facing away from the cartridge ejection port. In contrast to DE 196 16 397 C2 (Gühring et al.) specified above, the first and second edge sections 52, 54 of the releasing control edge 50 are parallel to the respective opposite fourth and fifth edge sections 62 and 64 of the locking control edge 60. Among other things, this has production advantages, because the parallel edges of the control guide can be formed more easily, such that differently angled control edges can be produced in a single pass with a milling machine.

In likewise differing from the aforementioned DE-PS 196 16 397 (Gühring et al.), the sixth edge section 70 (e.g., lower front edge) of the control guide 40 forms a circular, rounded opening, elongated in the longitudinal direction, the diameter of which in the longitudinal direction is slightly larger than the diameter of the feed regulator pin 36.

FIG. 6 also shows that there is an empty gap 81 between the feed regulator pin 36 remaining in its locked position, and the right-hand end of the control guide 40, thus the right-hand end of its seventh edge section 80. The feed regulator pin thus does not bear on the breechblock carrier when in the locked state.

The first control bevel, i.e. the first releasing edge section 52, initially serves to optimize the releasing function of the rotatable bolt head 20 controlled by the control guide 40 via the feed regulator pin 36. Because of its shallow angle, it serves as a lifting angle for releasing and initiating movement of the bolt head 20 under contact pressure. Because of the gentle slope of the first shallow releasing angle of the first releasing edge section 52 on the feed regulator pin, there is very little loss of speed in the return of the breechblock carrier 18.

Figure 7:
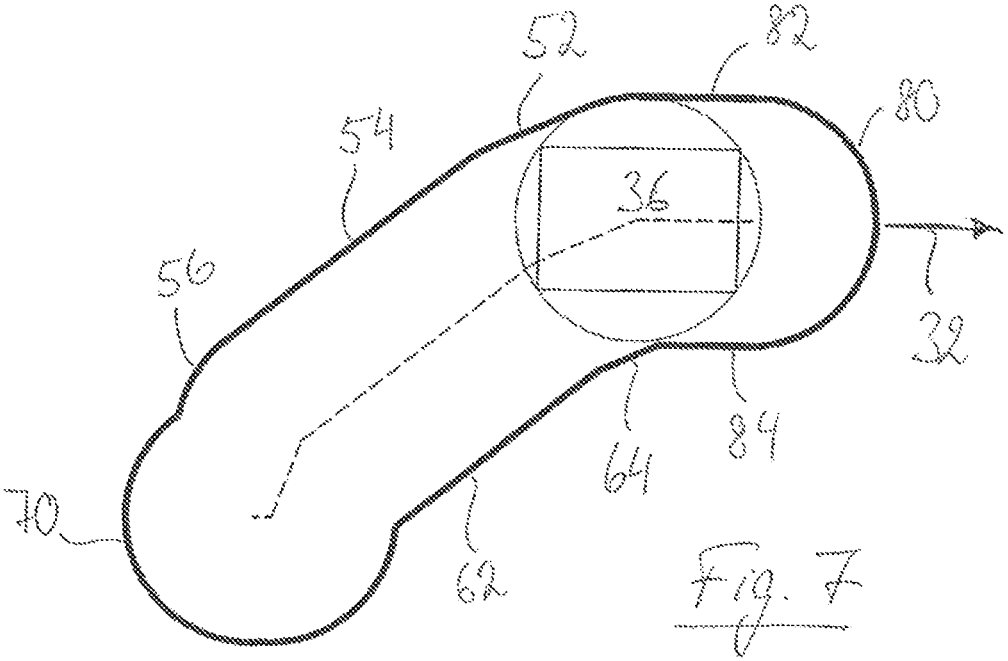

The control guide 40 is already returning in FIG. 7 due to the breechblock carrier 18 being driven back by the gas piston after the shot was fired.

Figure 8:
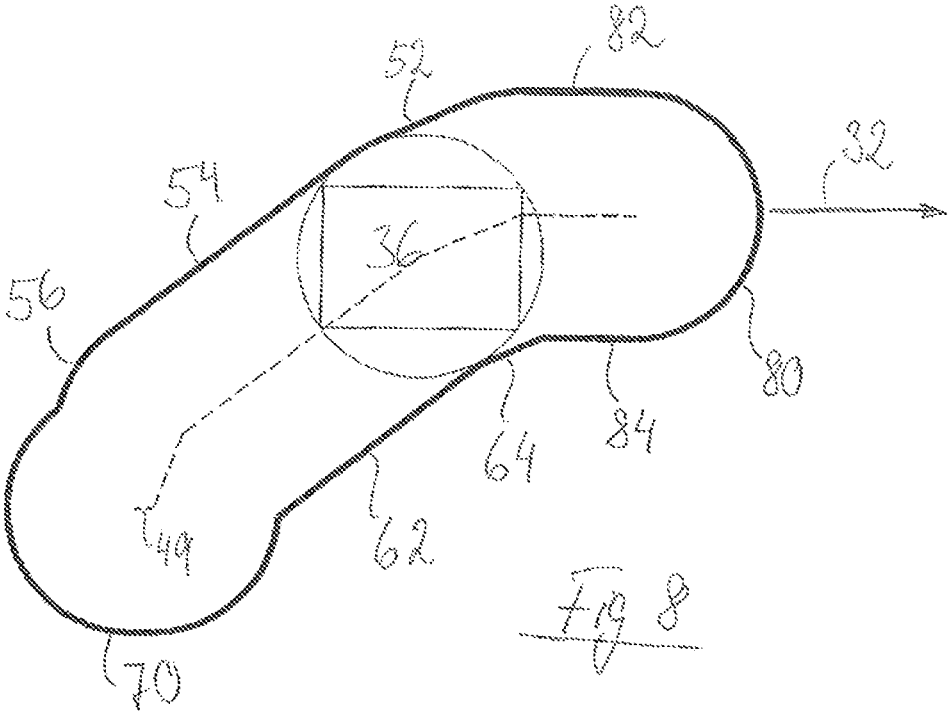
Figure 9:
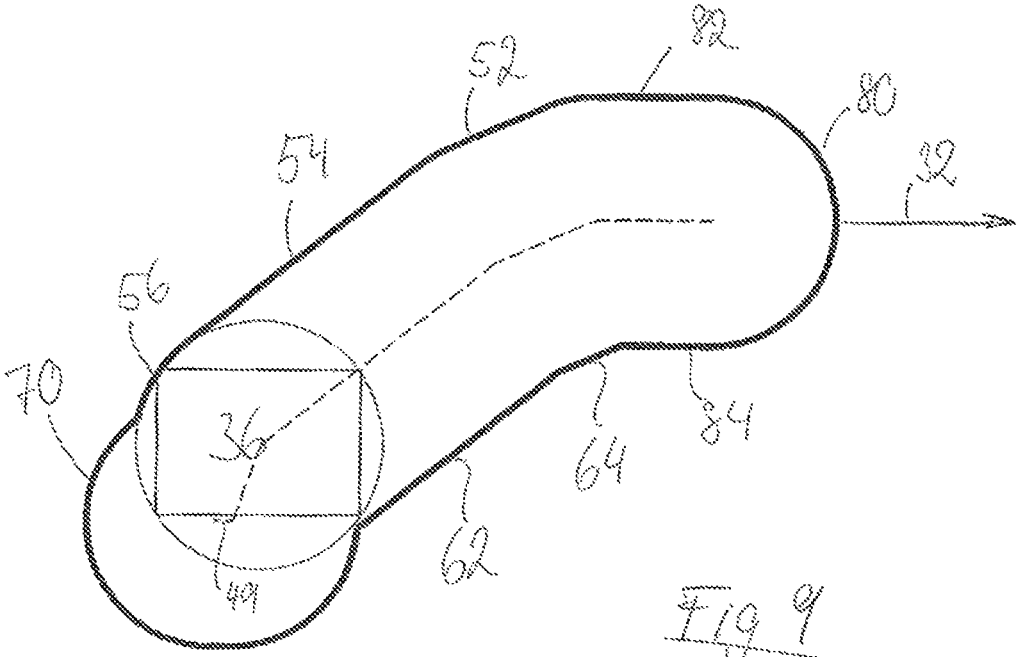

The breechblock carrier 18 continues to return in FIG. 8. The second edge section 54 runs along the periphery of the feed regulator pin 36 and again accelerates its rotational movement because of the steeper angle β. The releasing rotation of the bolt head 20 thus increases.

FIG. 9 again shows the breechblock carrier 18 in its return. Its third releasing edge section 56 then runs over the periphery of the feed regulator pin 36 and pushes the feed regulator pin 36 more quickly downward because of its strong curvature. The pivotal movement thereof, and thus the releasing rotation of the bolt head 20 is further accelerated.

The multi-step releasing and rotational acceleration of the bolt head 20 after firing a shot described above saves energy and ensures a fluid releasing procedure. After finally leaving the curved third releasing edge section 56 (FIG. 10), the feed regulator pin 36 is in its released state in the sixth edge section 70. This edge section has a basically elliptical shape, since the curvature radii of its front and rear sections each correspond to the radius of the feed regulator pin 36, but its longitudinal diameter is greater than the diameter of the feed regulator pin by the distance Δd.

Figure 11:
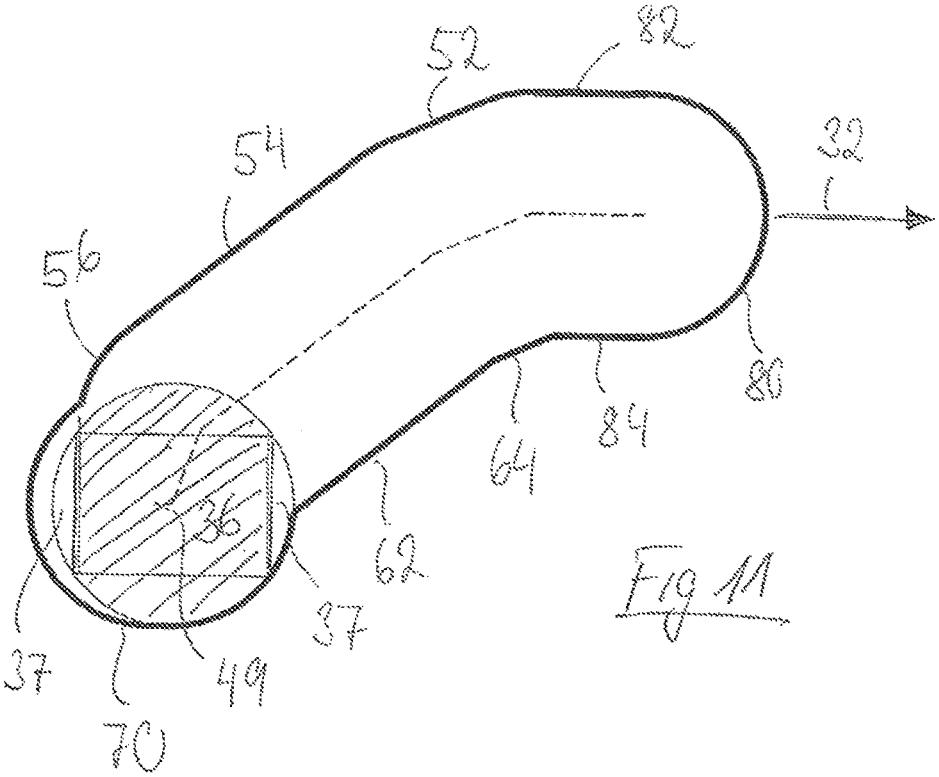

The feed regulator pin 36 then strikes the rear section of the sixth edge section 70 due to its exploitation of the residual pressure force in the barrel 2, and accelerates it again (see FIG. 11). The additional increase in the speed of the breechblock carrier 18 resulting from this can amount to up to 1 m/s or more, depending on the residual gas pressure in the barrel 2, thus depending on the location of the gas pressure relief mechanism 34 on the barrel and the caliber used, in particular the propellant.

At the same time, the impulse transfer from the feed regulator pin 36 to the breechblock carrier 18 is delayed by the amount Δd as a result of the extension of the longitudinal diameter.

Figure 10:
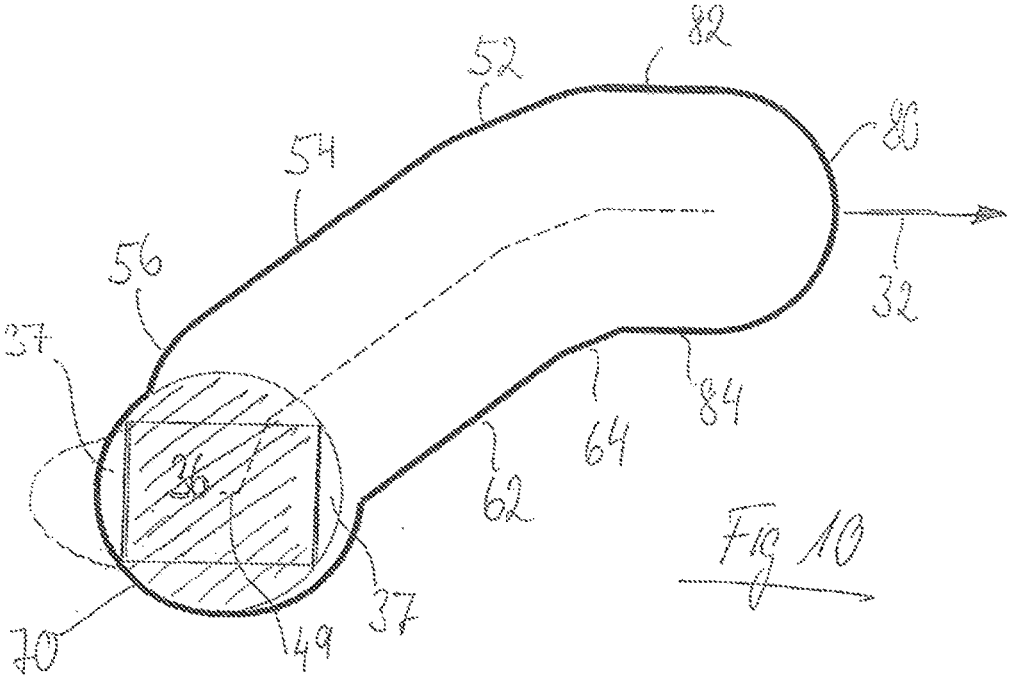
Figure 15:
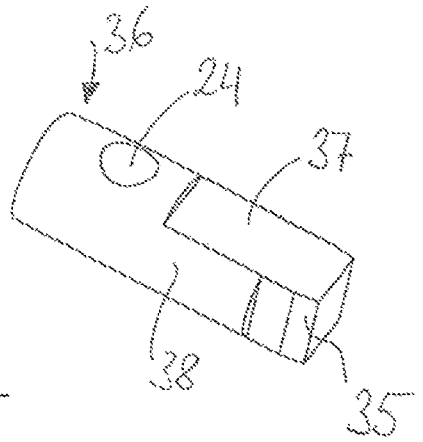
FIG. 15 is perspective view of the feed regulator pin of FIGS. 6-14.

The designs of the feed regulator pin 36 and the sixth edge section 70 shown in FIGS. 10, 11, and 15 are provided in order to then also ensure that the feed regulator pin 36 moves fully into its lowest position (releasing position) in the control guide 40 when firing under difficult conditions (e.g. sand and mud tests according to NATO AC225), when dirt is able to penetrate the control guide and other locations. The feed regulator pin 36 has a recess 37 in each of its periphery sections lying opposite the front and/or rear edge section of the sixth edge section 70, such that only the shaded region of the feed regulator pin 36 remains stationary. Additionally or alternatively, the sixth edge section 70 has an elliptical shape, extending in the longitudinal direction 4. The free space resulting from this serves as a dirt reservoir for residual dirt potentially located in the control guide, that cannot be removed quickly enough. When the control guide 40 moves further in relation to the feed regulator pin 36, any remaining dirt is normally automatically removed. A certain amount of accumulation, in particular prior to the first shot, may nevertheless result in high frictional losses and disruptions.

After the discharged/disobturated cartridge has been removed and discarded, the returning breechblock reaches its rearmost position in the body, after which the closing spring (not shown) that was tensioned during the return reverses direction and forces it forward toward the chamber 6.

Figure 13:
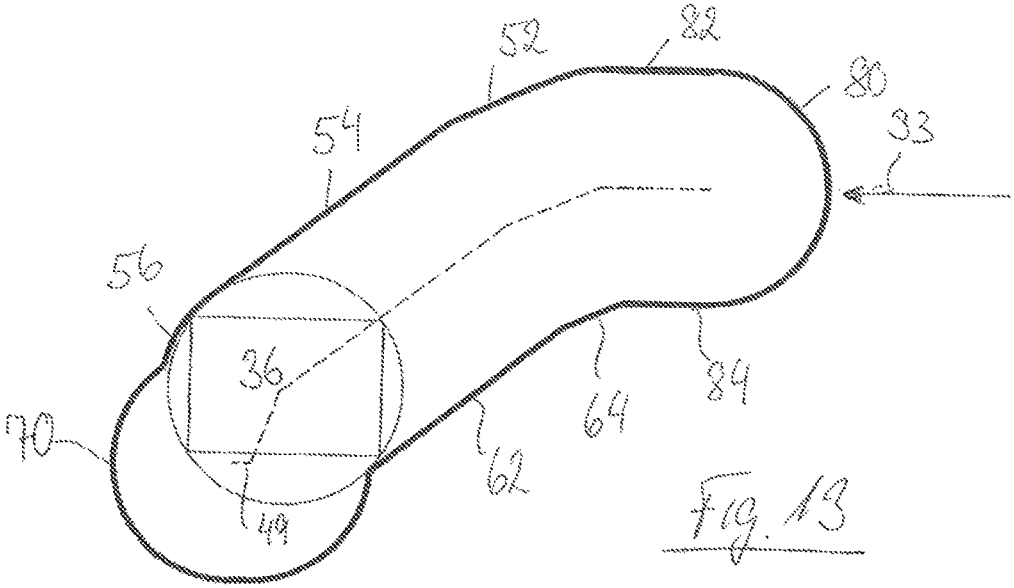
Figure 14:
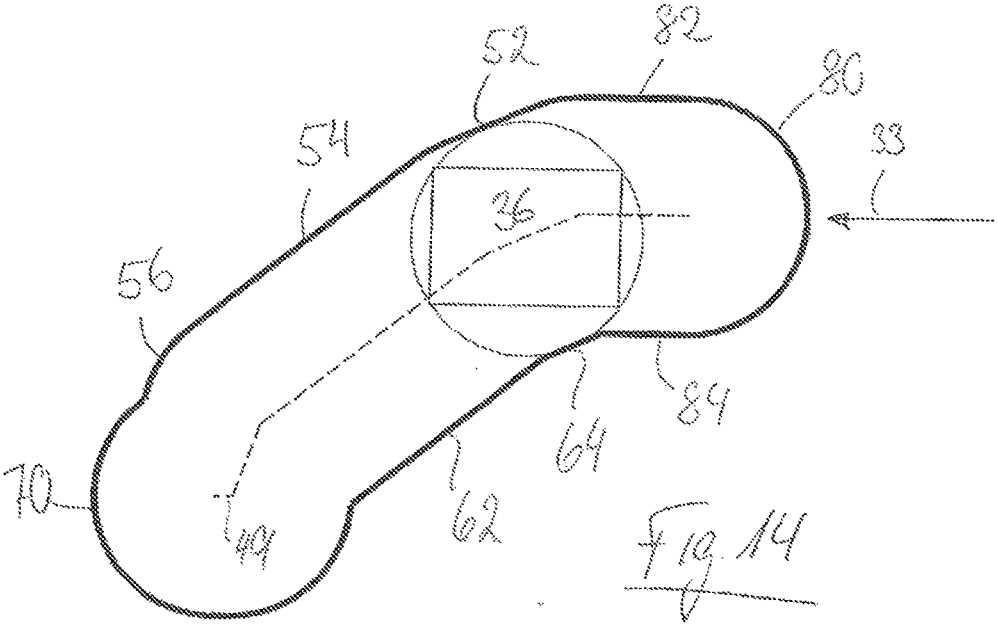

During the advance of the breechblock, the rear lower rounded surface of the feed regulator pin 36 bears, as shown in FIG. 12, on the rear, likewise rounded recess of the undersurface of the sixth edge section 70. The feed regulator pin 36 is retained thereby in its lower position by a guide rail 90, known per se, mounted in the receiver, and thus prevented from leaving this position prematurely. The bolt head 20 and the feed regulator pin 36 can then first pivot into the locked position after the breechblock 20 has reached its foremost position in the longitudinal direction 4 within the round chamber 16, i.e. in front of the chamber 6. When the bolt head 20 is in this position, the feed regulator pin 36 is already in front of the guide rail 90 in the longitudinal direction 4, and the advancing breechblock carrier 18 is then pivoted by the edge sections 62 and 64 of the locking control edge 60 into its locked position, as is shown in FIGS. 13 and 14.

FIG. 15 shows an exemplary embodiment of a feed regulator pin 36 with the bore 24 for the firing pin 26 and recesses 37 that provide a free space for any dirt penetrating the control guide 40. The section of the feed regulator pin 36 indicated by the reference numeral 36 extends out of the control guide 40. The peripheral firing pin upper surface 38 and the opposite peripheral firing pin undersurface are guided by the control edges of the control guide 40.

It is noted that this patent claims priority from DE Patent Application Serial Number 10 2017 002 190.2, which was filed on Mar. 7, 2017, and is hereby incorporated by reference in its entirety.

Although certain example methods and apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A lockable self-loading firearm, comprising:

a bolt head comprising a feed regulator pin extending traverse to a longitudinal direction with respect to the firearm;

a breechblock carrier in a receiver movable in a longitudinal direction with respect to the firearm, the breechblock carrier comprising:

a control guide extending diagonally in the longitudinal direction with respect to the firearm through which the feed regulator pin is disposed, the control guide comprising:

a releasing control edge, comprising:

a first straight edge section positioned at a shallow angle with respect to the longitudinal direction;

a second straight edge section positioned at a significantly greater angle than the first straight edge section with respect to the longitudinal direction; and a third curved edge section with tangents positioned at increasingly greater angles than the second straight edge section with respect to the longitudinal direction; and a locking control edge opposite the releasing control edge, the locking control edge comprising:

a fourth straight edge section positioned parallel with respect to the second straight edge section; and a fifth straight edge section positioned parallel with respect to the first straight edge section; and at a releasing end of the releasing control edge, a sixth arc-shaped edge section connecting a first end of the third curved edge section and a second end of the fourth straight edge section to receive the feed regulator pin in a releasing position, wherein the sixth arc-shaped edge section has a greater diameter than the feed regulator pin with respect to the longitudinal direction.

2. The firearm according to claim 1, wherein the bolt head is movable in the longitudinal direction to lock and release the firearm, and wherein a rear of the bolt head is pivotally mounted in the breechblock carrier to allow rotation about the longitudinal direction.

3. The firearm according to claim 1, wherein the bolt head remains longitudinally stationary during an opening movement of the breechblock carrier, and wherein the bolt head rotates with the opening movement and a closing movement of the breechblock carrier as a result of the releasing control edge releasing the feed regulator pin.

4. The firearm according to claim 3, wherein the bolt head is stationary during a start phase of the closing movement, and wherein the bolt head rotates backward during an end phase of the closing movement as a result of the locking control edge locking the feed regulator pin.

5. The firearm according to claim 1, wherein a radius of curvature of a portion of the sixth edge section connecting to at least one of the third edge section or the fourth edge section corresponds to a radius of the feed regulator pin.

6. The firearm according to claim 1, wherein a difference between a longitudinal diameter of the sixth edge section and a diameter of the feed regulator pin is within a range of 0.2 mm to 1 mm.

7. The firearm according to claim 1, wherein a seventh edge section connects a first end of the first edge section with a second end of the fifth edge section in a substantially U-shaped manner at the locking control edge, and wherein the first end and the second end of the seventh edge section are parallel with respect to the longitudinal direction and transition into the first edge section and the fifth edge section respectively.

8. The firearm according to claim 7, wherein a first length of the first end of the seventh edge section is longer than a second length of the second end of the seventh edge section, and wherein the first length measures 6 mm and the second length measures 2 mm.

9. The firearm according to claim 1, wherein a first spacing between the first edge section and the fifth edge section, a second spacing between the second edge section and the fourth edge section, and a third spacing between a first end and a second end of a seventh edge section substantially correspond to a diameter of the feed regulator pin.

10. The firearm according to claim 1, wherein a length of the control guide allows for longitudinal displacement of the breechblock carrier with respect to the feed regulator pin within a range of 9 mm to 17 mm.

11. The firearm according to claim 1, wherein a first angle corresponding to the first edge section is within a range of 16° to 32° with respect to the longitudinal direction, and wherein a second angle corresponding to the second edge section is within a range of 30° to 45° with respect to the longitudinal direction, and wherein a third angle corresponding to at least one of the tangents of the third edge section is within a range of 55° to 85° with respect to the longitudinal direction.

12. The firearm according to claim 1, wherein at least one of the sixth arc-shaped edge section or an exterior surface of the feed regulator pin that is adjacent or opposite the sixth arc-shaped edge section comprises a recess to receive dirt at a front end with respect to the longitudinal direction.

13. The firearm according to claim 1, wherein a horizontal guide rail is disposed in the receiver and retains the feed regulator pin in a released position when returning and advancing with the breechblock carrier, and wherein the horizontal guide rail dismisses the feed regulator pin when locking lugs of the bolt head advance to a position between one of corresponding counter-locking lugs on a rear end of a rear barrel attachment or a locking bushing.

14. The firearm according to claim 1, wherein the control guide is disposed opposite a cartridge ejection port with respect to a lateral direction, and wherein the releasing control edge is positioned above the locking control edge.

15. The firearm according to claim 1, wherein the firearm is a gas-operated reloading firearm.

* * * * *